US009862580B2

(12) United States Patent
Cook

(10) Patent No.: US 9,862,580 B2
(45) Date of Patent: Jan. 9, 2018

(54) LIFT TRUCK ACCESSORY

(71) Applicant: Antony Edward Cook, Alsager (GB)

(72) Inventor: Antony Edward Cook, Alsager (GB)

( * ) Notice: Subject to any disclaimer, the term of this patent is extended or adjusted under 35 U.S.C. 154(b) by 159 days.

(21) Appl. No.: 14/774,842

(22) PCT Filed: Mar. 3, 2014

(86) PCT No.: PCT/GB2014/050617

§ 371 (c)(1),
(2) Date: Sep. 11, 2015

(87) PCT Pub. No.: WO2014/140527

PCT Pub. Date: Sep. 18, 2014

(65) Prior Publication Data

US 2016/0031689 A1 Feb. 4, 2016

(30) Foreign Application Priority Data

Mar. 14, 2013 (GB) ..... 1304584.4

(51) Int. Cl.
*B66F 9/075* (2006.01)
*B66F 9/08* (2006.01)
*B66F 17/00* (2006.01)

(52) U.S. Cl.
CPC ..... *B66F 9/0755* (2013.01); *B66F 9/082* (2013.01); *B66F 17/003* (2013.01)

(58) Field of Classification Search
CPC . G01C 9/12; G01C 9/00; G01C 15/10; G01C 15/004; G01C 15/008;
(Continued)

(56) References Cited

U.S. PATENT DOCUMENTS 2,374,298 A 2/1943 Nasset
2,569,053 A * 9/1951 Healy ..... B66F 9/08 180/215

(Continued)

FOREIGN PATENT DOCUMENTS

DE 42 18 269 A1 12/1993
DE 10 2011 112 155 A1 10/2012

(Continued)

OTHER PUBLICATIONS

International Search Report Issued by the European Patent Office for PCT/GB2014/050617 dated Apr. 17, 2014.

*Primary Examiner* — Glenn Myers
(74) *Attorney, Agent, or Firm* — Shumaker, Loop & Kendrick, LLP

(57) ABSTRACT

An industrial lift truck with a tilt measuring accessory, which provides an operator with a visual indication of the mast assembly tilt angle by means of a flexible cable operated sliding weight indicator mounted on the mast assembly. The flexible cable is fixedly mounted by a mounting device to a roll-cage and extends parallel, or substantially so, to the surface on which the lift truck is operating, before passing over a pulley mounted on the mast assembly to extend downwardly and parallel, or substantially so, to the mast assembly. The sliding weight is received for sliding engagement within a guide, wherein, when the mast assembly is tilted, movement of the flexible cable causes a corresponding movement of the weight relative to the guide thereby giving the visual indication of the angle of tilt of the mast assembly.

12 Claims, 4 Drawing Sheets

(58) Field of Classification Search
CPC ..... G01C 15/105; B66F 9/082; B66F 9/0755; B66F 17/003; B66F 9/07; B66F 9/205; B66F 9/07554; E02F 9/264
See application file for complete search history.

(56) References Cited

U.S. PATENT DOCUMENTS

| | | | | | |
|---|---|---|---|---|---|
| 2,723,771 | A | * | 11/1955 | Brown | B66F 9/06 414/638 |
| 2,941,496 | A | * | 6/1960 | Leischer | E02F 3/36 116/296 |
| 3,049,257 | A | * | 8/1962 | Bertenshaw | B66F 9/082 414/635 |
| 3,865,265 | A | * | 2/1975 | Brudi | B66F 17/003 212/277 |
| 3,883,021 | A | * | 5/1975 | Wilhelm | B66F 9/0755 116/304 |
| 5,131,801 | A | * | 7/1992 | Melanson | B66F 9/082 33/366.26 |
| 5,697,755 | A | | 12/1997 | McCauley | |
| 8,157,500 | B1 | | 4/2012 | Husmann | |

FOREIGN PATENT DOCUMENTS

| | | | |
|---|---|---|---|
| GB | 2 285 250 | A | 7/1995 |
| JP | S57 52609 | U | 3/1982 |
| JP | 2001 294399 | A | 10/2001 |

* cited by examiner

LIFT TRUCK ACCESSORY

FIELD OF THE INVENTION

The present invention relates to industrial lift trucks and an accessory for such trucks.

BACKGROUND TO THE INVENTION

Industrial lift trucks, such as forklift trucks, an example 1 of which is shown in FIG. 1, typically include a body 3 housing the operator 2, controls and means of propulsion over a surface 0, and a mast assembly 4. The mast assembly carries the forks 5 or other lifting attachments which are movable up and down the mast assembly. As illustrated in FIG. 2, the mast assembly is mounted such that it can be pivoted relative to the truck body, and thereby the angle of the forks can be changed by adjusting the tilt angle of the mast.

Operators of such industrial lift trucks generally have difficulty in determining the required tilt angle of the mast to align the angle of the forks with the load that is to be lifted. This in the main is due to the orientation of tilt being parallel to the operator's line of sight from the operating position. The operator therefore receives limited visual indication of the tilt angle. This is exacerbated as the mast is extended vertically.

Correct alignment of the forks requires a high degree of operator skill and frequent fine adjustment of the mast tilt controls. Inevitably there are occasions when the operator fails to correctly align the forks with the load.

The consequences of misaligned forks can be damage to the pallet being lifted, damage to the load on the pallet, damage to racking systems and personal injury. Each of these have significant associated costs.

STATEMENT OF INVENTION

Embodiments of this invention relate to an accessory that can be fitted to a lift truck to provide a visual indication of the mast tilt angle, and thereby increase operator efficiency, reduce incidences of damage caused by misaligned forks, and thereby reduce associated costs.

The mast tilt angle relative to the floor is normally approximately proportional to the distance between the top of the lower mast and a point on the truck body at a similar height above the ground. Embodiments of the invention can transpose changes in this distance to a motion perpendicular to the operator's line of sight.

This can be achieved with a cable, pulley and weight system.

The advantages of embodiments of this invention are that it is simple, it is inexpensive, it gives immediate and analogue indication of mast angle to the operator, the indication is at the eye-level of the operator, the indication is not effected by movement of the truck, and it will operate on inclined floors.

According to one aspect of the present invention there is provided an industrial lift truck comprising a body housing for an operator, controls, means of propulsion and a mast assembly having forks, or other lifting attachments, which are movable up and down the mast assembly, the mast assembly mounted on the lift truck so that, in use, the mast assembly is pivoted relative to the lift truck body whereby an angle of the forks is changed by adjusting a tilt angle of the mast assembly, wherein the lift truck also comprises a tilt measuring accessory for providing, in use, a visual indication of the mast tilt angle, wherein the tilt measuring accessory is mounted between the body housing and the mast assembly, and wherein the tilt measuring accessory comprises:

a flexible cable connected by a mounting device between the body housing and the mast assembly, a pulley, the flexible cable extending, in use, parallel, or substantially so, to a surface on which the lift truck is operating, and after passing over the pulley the flexible cable extends downwardly in parallel, or substantially so, with the mast assembly to provide support for a weight at a lower end thereof, the weight being located for sliding movement within a guide of the tilt measuring assembly.

When the lift truck is in use and the mast assembly is tilted, the relative distance between the mounting device and the pulley can change. When the lift truck is in use and the mast assembly is tilted backwards the distance between the mounting device and the pulley can decrease. When the lift truck is in use and the mast assembly is tilted forwardly, the distance between the mounting device and the pulley can increase.

Movement of the flexible cable as the mast assembly is tilted can cause a corresponding movement of the weight relative to the guide to provide a visual indication to an operator of the lift truck according to the angle of tilt of the mast assembly. The guide and/or the weight can be provided with lines and/or coloured bands, or other forms of demarcation, which, in use, provide a visual indication to an operator of the tilt angle of the mast assembly.

According to another aspect of the present invention there is provided an industrial lift truck tilt measuring accessory including:

a flexible cable connected, in use, by a mounting device between a body housing and a mast assembly of an industrial lift truck, a pulley, the flexible cable extending, in use, parallel, or substantially so, to a surface on which the lift truck operates in use, and after passing over the pulley the flexible cable extends downwardly in parallel, or substantially so, with the mast assembly to provide support for a weight at a lower end thereof, the weight being located for sliding movement within a guide of the tilt measuring assembly.

According to yet another aspect of the present invention there is provided a lift truck accessory that provides a visual indication of mast angle by means of the position of a sliding weight and a guide fixed to the mast, the position of said weight being governed by the relative position of the mast and the truck body, being connected between the mast and truck by a flexible cable and pulley.

The pulley function may be provided by a sheave, elbow tube or eyelet. The flexible cable may be mounted to the truck by means of an adjusting device which allows the length of the cable to be finely adjusted. The guide and weight may incorporate lines or coloured bands which interact to create an indication scale between their relative positions. The pulley and guide may be integrated to form one component. The mounting may be reversed so that the cable mounting device is affixed on the mast, and the pulley and guide are mounted on the vehicle body.

BRIEF DESCRIPTION OF THE DRAWINGS

An example of the invention will now be described by referring to the accompanying drawings.

DETAILED DESCRIPTION

Figure 1:
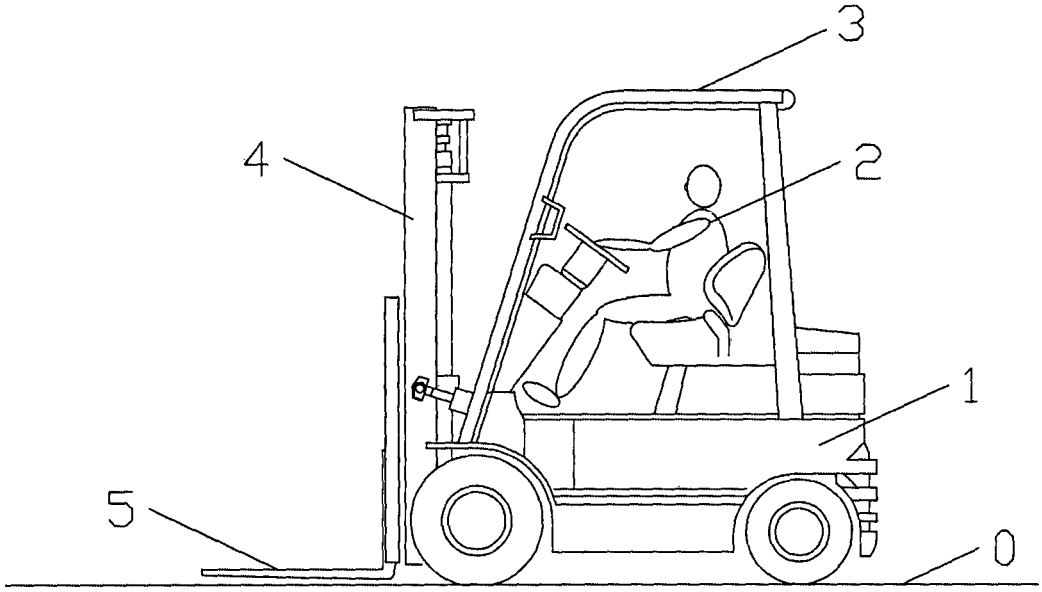
FIG. 1 shows a typical forklift truck as an example of an industrial lift truck, and identifies its main parts.
Figure 2:
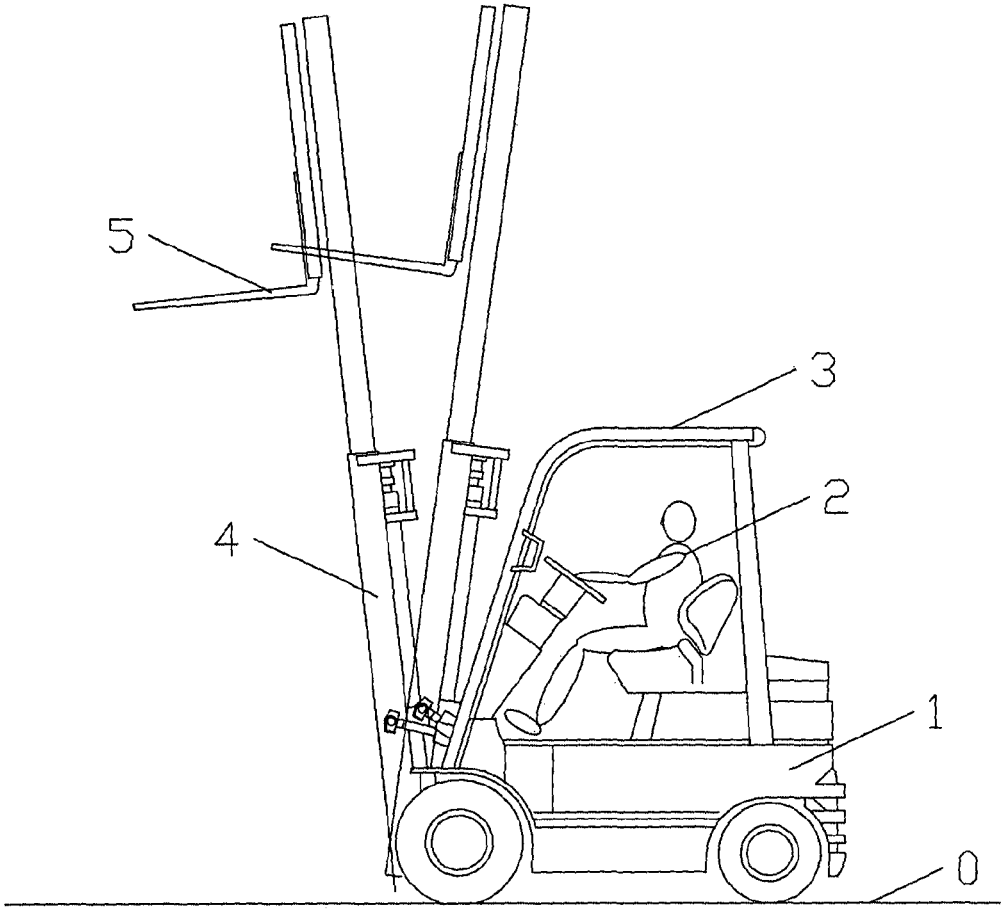
FIG. 2 shows how the mast and forks can move relative to the truck body.
Figure 3:
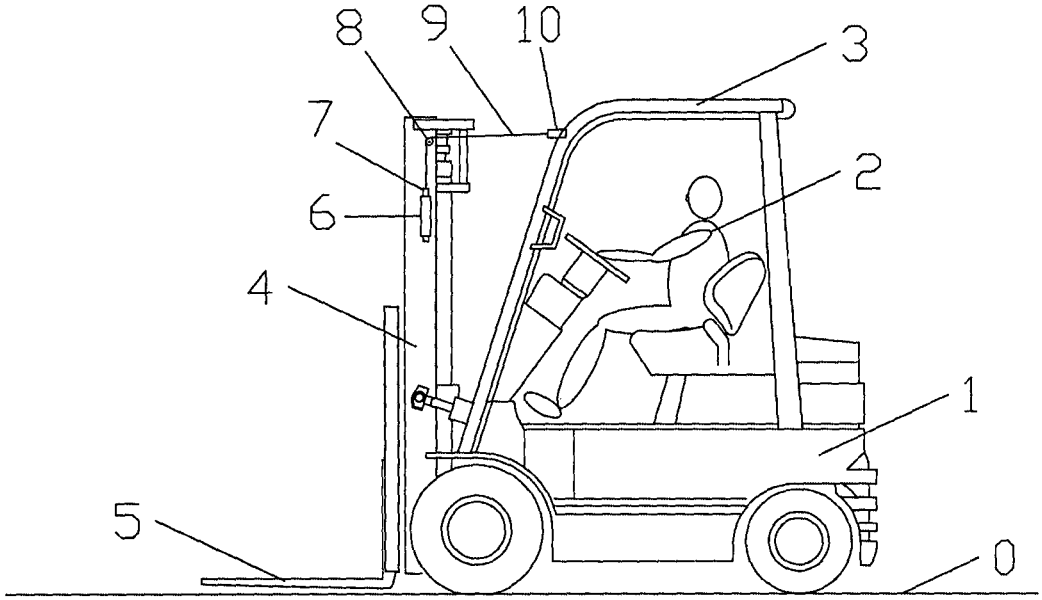
FIG. 3 shows the mast tilt angle indicator according to an embodiment of this invention.

An embodiment of the present invention, see FIG. 3, comprises a lift truck 1 provided with a flexible cable 9 connected to a roll-cage 3 of the lift truck 1 by a mounting device 10. The cable 9 runs from the mounting device 10 in an approximately horizontal direction to a pulley 8, which is affixed to the lower section of a mast 4 of the lift truck 1. Thus, components of the tilt measuring accessory are mounted between the body housing and the mast assembly.

The cable 9 changes direction in the pulley 8 to run parallel to and down the mast 4. The end of the cable 9 is fixed to a weight 7. The weight 7 is restrained by, but free to slide within, a guide 6, which is fixed to and orientated vertically on the mast 4. The guide 6 is mounted approximately at eyelevel of the operator 2. The weight 7 keeps the cable 9 under constant tension.

In the illustrated example, the weight 7 is cylindrical, and is constrained concentrically within guide 6 which is tubular. The weight 7 is equal length or longer than guide 6. The weight 7 and guide 6 are mounted such that, with the forks 5 in a level position relative to the surface 0 on which the lift truck 1 is operating, the weight 7 is symmetrically within the guide 6.

During operation of the lift truck 1 and as the mast 4 is tilted, the relative distance between the mounting device 10 and the pulley 8 will change. If the mast 4 is tilted back, then the distance between the mounting device 10 and the pulley 8 will decrease. Conversely, if the mast 4 is tilted forward, then the distance between the mounting device 10 and the pulley 8 will increase.

Since the cable 9 has a fixed length, any change in tilt of mast 4 will result in weight 7, being acted on by gravity and cable tension, sliding within guide 6. The relative position of weight 7 within guide 6 therefore gives a visual indication to the operator 2 of the tilt angle of the mast 4 and forks 5 of the lift truck 1 relative to the surface 0 on which the lift truck 1 is working, see FIG. 3.

Backward tilt of the mast 4 will result in (the bottom end of) the weight 7 appearing partially below the bottom end of the guide 6 and, conversely, a forward tilt of the mast 4 will result in (the top end of) the weight 7 appearing partially above the top end of the guide 6.

Thus, it will be appreciated that the mast 4 is at a right angle to the surface 0 on which the lift truck 1 is working when the weight 7 appears to be centralised within the guide 6.

Other embodiments of the lift truck 1 accessory are envisaged within the scope of the Claims appended hereto.

For example, the function of the pulley 8 may be provided by a sheave, elbow or eyelet.

Also, the flexible cable 9 may be mounted on the lift truck by means for allowing the length of the cable 6 to be adjusted, thereby providing a means to calibrate the indicator.

The guide 6 and the weight 7 may be usefully provided with lines, coloured bands, or other markings, which indicate to a lift truck operator the degree of angle of tilt of the mast 4.

The guide 6 and weight 7 may engage by other sliding means, for instance pegs and slots.

The weight 7 may be shorter than the guide 6, with other means of determining their relative positions, for instance, the guide 6 may incorporate a window, or be transparent, so that the position of the weight 7 can be viewed within.

The guide 6 and pulley 8 functions could be incorporated into one component, for instance a tube with 90° bend.

Figure 4:
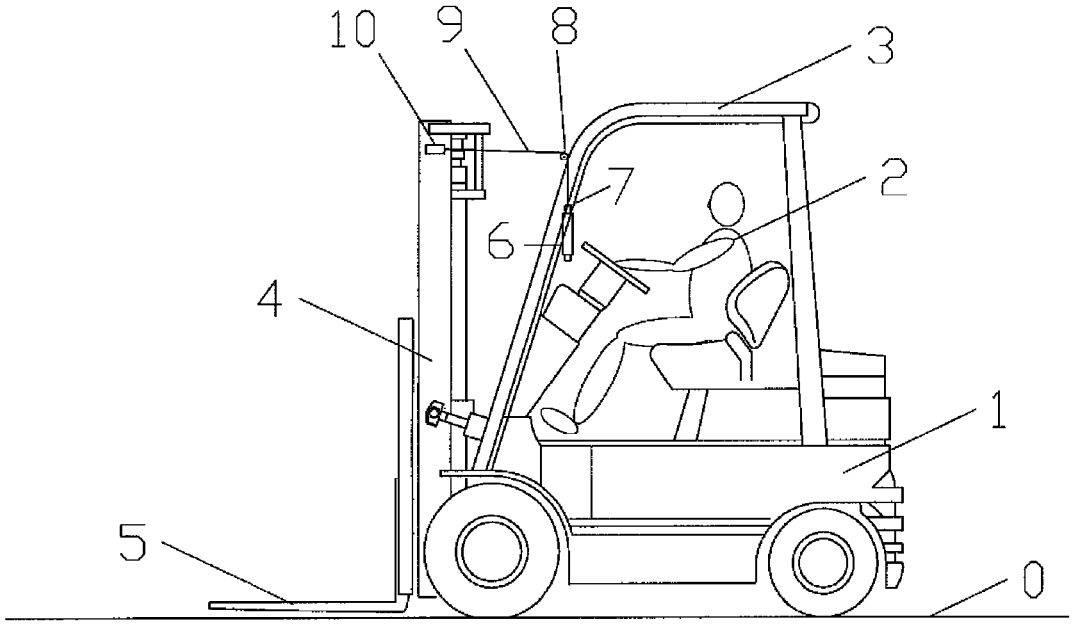
FIG. 4 shows the mast tilt angle indicator according to a further embodiment of the invention.

In an alternative arrangement of the invention, see FIG. 4, the cable mounting device is fixed on the mast 4 and a pulley 8 and guide 6 are mounted on the lift truck body.

The invention claimed is:

1. An industrial lift truck comprising a body housing for an operator, controls, means of propulsion and a mast assembly having forks, or other lifting attachments, which are movable up and down the mast assembly, the mast assembly mounted on the lift truck so that, in use, the mast assembly is pivoted relative to the body housing whereby an angle of the forks or other lifting attachments is changed by adjusting a tilt angle of the mast assembly, wherein the lift truck also comprises a tilt measuring accessory for providing, in use, a visual indication of the mast tilt angle, wherein the tilt measuring accessory is mounted between the body housing and the mast assembly, and wherein the tilt measuring accessory comprises:

a flexible cable connected to a mounting device between the body housing and the mast assembly; and a pulley;

the flexible cable extending, in use, substantially parallel to a surface on which the lift truck is operating, and after passing over the pulley the flexible cable extends downwardly substantially parallel with the mast assembly to provide support for a weight at a lower end of the flexible cable, the weight being located for sliding movement within a guide of the tilt measuring assembly.

2. The industrial lift truck according to claim 1, wherein the mounting device is fixed to a roll-cage of the body housing, and the pulley is secured to the mast assembly.

3. The industrial lift truck according to claim 1, where, when the lift truck is in use and the mast assembly is tilted, a relative distance between the mounting device and the pulley changes.

4. The industrial lift truck according to claim 3, where, when the lift truck is in use and the mast assembly is tilted backwards the distance between the mounting device and the pulley decreases.

5. The industrial lift truck according to claim 2, where, when the lift truck is in use and the mast assembly is tilted forwardly, the distance between the mounting device and the pulley increases.

6. The industrial lift truck according to claim 3, wherein movement of the flexible cable as the mast assembly is tilted causes a corresponding movement of the weight relative to the guide to provide a visual indication to an operator of the lift truck according to the tilt angle of tilt of the mast assembly.

7. The industrial lift truck according to claim 6, wherein the guide and/or the weight are provided with lines or colored bands, which, in use, provide a further visual indication to the operator of the tilt angle of the mast assembly.

8. The industrial lift truck according to claim 1, wherein the mounting device is fixed to the mast assembly and the pulley and the guide are mounted on a roll-cage of the body housing.

9. The industrial lift truck according to claim 1, wherein a position of the weight is viewable within the guide.

10. An industrial lift truck tilt measuring accessory, comprising:

a flexible cable connected, in use, to a mounting device between a body housing and a mast assembly of an industrial lift truck; and a pulley;

the flexible cable extending between the pulley and the mounting device, in use, substantially parallel to a surface on which the lift truck operates in use, and after passing over the pulley the flexible cable extends downwardly substantially parallel with the mast assembly to provide support for a weight at a lower end of the flexible cable, the weight being located for sliding movement within a guide of the tilt measuring assembly.

11. The industrial lift truck measuring accessory according to claim 10, wherein a position of the weight is viewable within the guide.

12. The industrial lift truck measuring accessory according to claim 10, wherein movement of the flexible cable as the mast assembly is tilted causes a corresponding movement of the weight relative to the guide to provide a visual indication to an operator of the industrial lift truck according to the tilt angle of the mast assembly.

* * * * *